US005222536A

United States Patent [19]

Hodgdon et al.

[11] Patent Number: 5,222,536

[45] Date of Patent: Jun. 29, 1993

[54] REFUSE COLLECTOR WITH HINGED COLLECTION TRAY FOR USE WITH A TRASH BAG

[76] Inventors: Marion Y. Hodgdon, 3570 Arizona; Henn Oona, 103 Beryl, both of Los Alamos, N. Mex. 87544

[21] Appl. No.: 866,624

[22] Filed: Apr. 10, 1992

[51] Int. Cl.[5] ..... B65B 67/04

[52] U.S. Cl. ..... 141/390; 141/108; 141/114; 141/316; 248/99; 15/257.001; 53/381.1

[58] Field of Search ..... 141/390, 391, 317, 314, 141/315, 316, 108, 114; 15/257.1; 248/99-101; 53/381 A, 390

[56] References Cited

U.S. PATENT DOCUMENTS

| | | | |
|---|---|---|---|
| 1,086,002 | 2/1914 | Stewart | 141/390 |
| 3,905,406 | 9/1975 | Cruse | 141/390 |
| 4,006,928 | 2/1977 | Beugin | 15/257.1 X |
| 4,299,365 | 11/1981 | Battle | 248/99 |
| 4,312,531 | 1/1982 | Cross | 248/99 X |
| 4,479,344 | 10/1984 | Edwards | 53/390 |
| 4,548,372 | 10/1985 | Lutzker | 248/99 |
| 4,550,440 | 10/1985 | Rico | 248/99 X |
| 4,659,045 | 4/1987 | Flynn | 248/99 |
| 4,664,348 | 5/1987 | Corsaut, III et al. | 248/99 |
| 4,981,274 | 1/1991 | McVay et al. | 248/99 |
| 5,050,920 | 9/1991 | Potticary | 248/100 |

FOREIGN PATENT DOCUMENTS

| | | | |
|---|---|---|---|
| 923477 | 3/1973 | Canada | 15/257.1 |
| 390538 | 4/1933 | United Kingdom | 141/391 |

*Primary Examiner*—Ernest G. Cusick
*Attorney, Agent, or Firm*—William A. Eklund

[57] ABSTRACT

A refuse collector for introducing solid refuse into commercial plastic trash bags is disclosed. The collector includes a open, peripheral frame having a collection tray hinged thereto, and a pair of expander arms that extend rearwardly from the frame and into a plastic trash bag to hold the bag open. The collector is particularly adapted to collection of hazardous solid waste such as metal chips or refuse contaminated toxic or infectious materials. The collector may be used in a horizontal or vertical position, and folds into a compact configuration for storage.

7 Claims, 5 Drawing Sheets

REFUSE COLLECTOR WITH HINGED COLLECTION TRAY FOR USE WITH A TRASH BAG

BACKGROUND OF THE INVENTION

1. Field of the Invention

The invention described and claimed herein is generally related to waste disposal devices and apparatus. More specifically, the present invention is related to devices for manual collection of solid waste that may be hazardous or toxic.

2. Description Of Related Art Including Information Disclosed Under 37 CFR 1.97-1.99.

The present invention is directed to the common chore of collecting refuse in plastic trash bags for disposal. This is normally an uneventful task in the case of common household refuse such as leaves and other common household trash. However, it poses certain risks when the refuse consists of materials that are hazardous, toxic or contaminated with infectious agents. In such situations the common problem of holding the bag open while sweeping or otherwise transporting the refuse into the bag results in an awkward situation that can expose the user to contact with the hazardous refuse. Hazardous wastes, for example sharp metal chips and slivers from industrial operations, constitute one type of hazardous exposure. Similarly, medical and industrial wastes may pose a risk of exposure to toxic or infectious agents.

Various devices have been commercially available for assisting in holding the bag open while it is filled. None of the previously known devices, however, are adapted for the specific purpose of avoiding manual contact with the refuse as it is transported into a plastic trash bag.

Accordingly, it is the object and purpose of the present invention to provide a device to facilitate the introduction of refuse into common plastic trash bags.

More particularly, it is an object and purpose of the present invention to provide a device which facilitates the introduction of hazardous, toxic or infectious refuse into trash bags while minimizing the risk of contact with the user.

SUMMARY OF THE INVENTION

The present invention provides a refuse collector for use with a plastic trash bag. The refuse collector includes a rigid peripheral frame member defining a central opening therein. A collection tray is hinged to a lower edge of the peripheral frame. The collector further includes first and second bag expander arms which are hinged to the rear of the frame member and which are extendable rearwardly therefrom into a trash bag. The frame member and the expander arms are sized and adapted so that the expander arms hold the bag open and positioned to receive refuse introduced into the bag from the collection tray and through the opening in the frame member.

In the preferred embodiment the frame member includes a tubular lower frame arm, and the collection tray includes an integral hinge in the form of a continuous edge member thereof which is curled so to partially enclose the tubular lower frame arm, thereby functioning as a hinge to allow the collection tray to rotate about the lower frame arm.

In accordance with another aspect of the invention the frame member is generally rectangular and includes four frame arms connected by hinge joints, with the bag expander arms each being hinged to the hinge joints for swinging motion between a rearwardly extending position and a compact folded position for storage. The hinge joints include integral resilient detents for retaining said expander arms in either rearwardly extended or the folded positions. In the preferred embodiment the hinge joints are formed of a resilient polymeric material and are generally cylindrical in configuration, with each hinge joint including a rearwardly opening central cylindrical bore transected by a longitudinal slot passing through the hinge joint. The ends of the expander arms are insertable into the cylindrical bores of said joints and are retained by pivot pins.

These and other aspects of the present invention will be more apparent upon consideration of the following detailed description of the invention, when taken with the accompanying drawings.

BRIEF DESCRIPTION OF THE DRAWINGS

The Figures set forth in the accompanying drawings form a part of this specification and are hereby incorporated by reference. In the Figures.

The structure and function of the invention is best understood by reference to the attached drawings when taken with the following detailed description of a preferred embodiment.

DESCRIPTION OF THE PREFERRED EMBODIMENT

Figure 1:
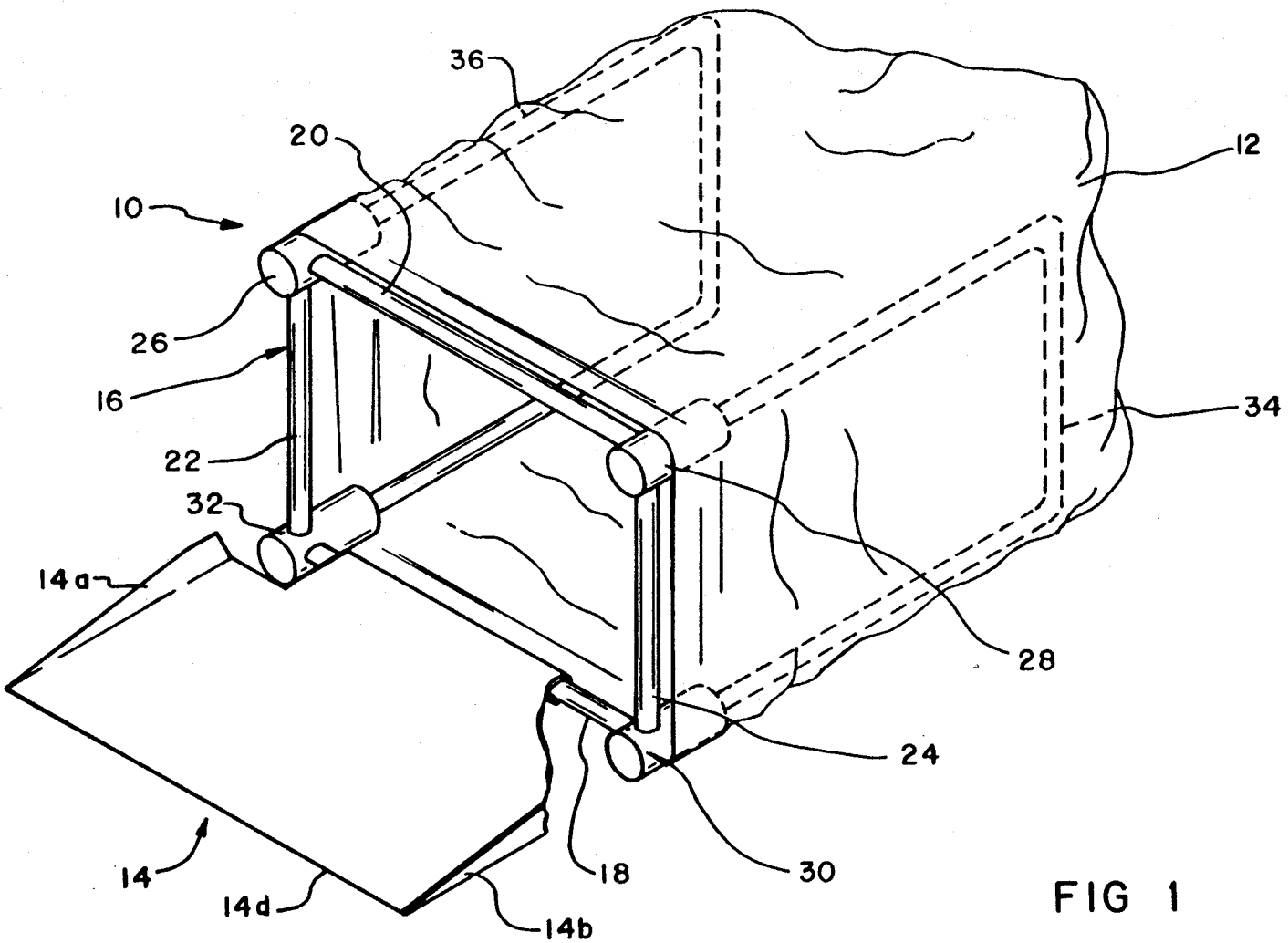
FIG. 1 is an isometric view of a preferred embodiment of the refuse collector of the present invention, shown as used with a plastic trash bag.

Referring to the Figures, there is illustrated a refuse collector 10 which constitutes a preferred embodiment of the present invention. FIG. 1 illustrates the refuse collector 10 as it is ordinarily used in combination with a plastic trash bag 12. The trash bag 12 forms no part of the present invention.

Figure 5:
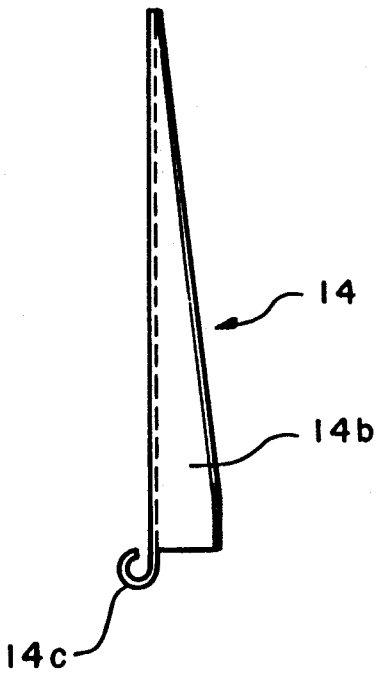
FIG. 5 is a side view of the collection tray of the refuse collector.

The collector 10 includes a collection tray 14, shown separately in FIG. 5, which is hinged to a rectangular frame 16. The rectangular frame 16 includes lower and upper frame arms 18 and 20, respectively, and side arms 22 and 24.

Figure 3:
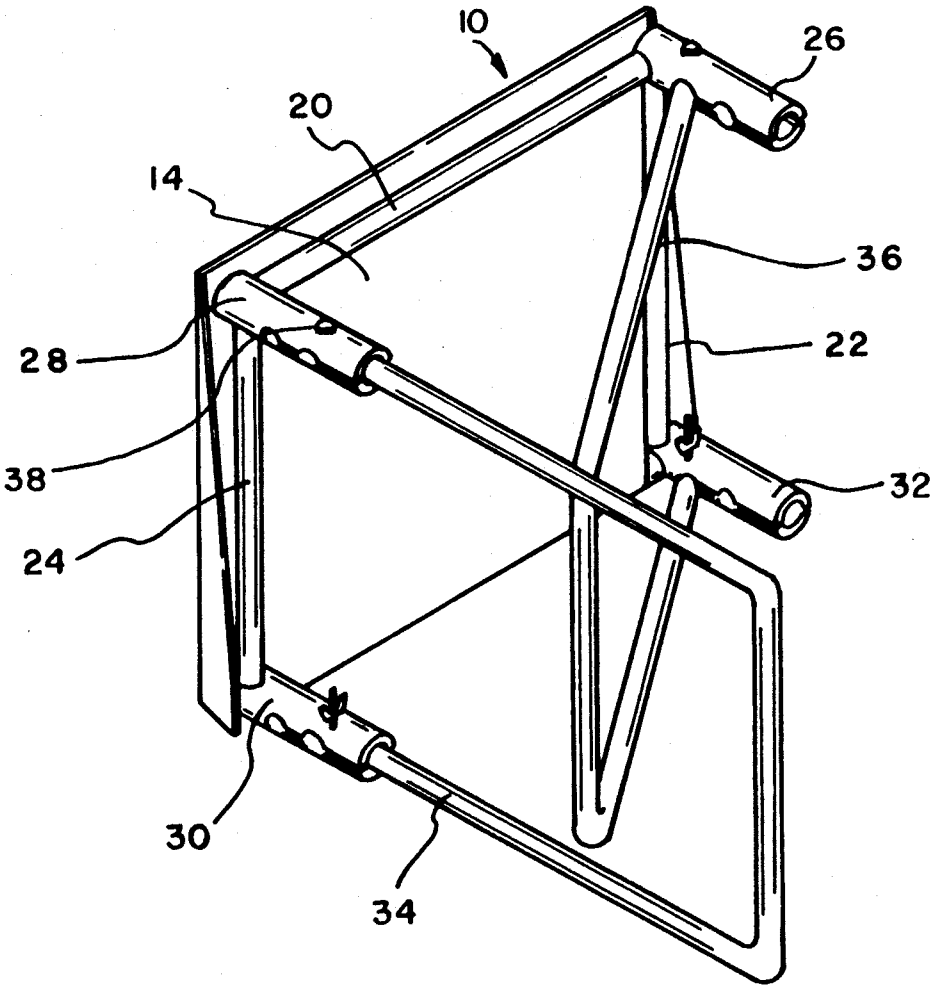
FIG. 3 is a rear isometric view of the refuse collector being folded into a compact folded position for storage.
Figure 4:
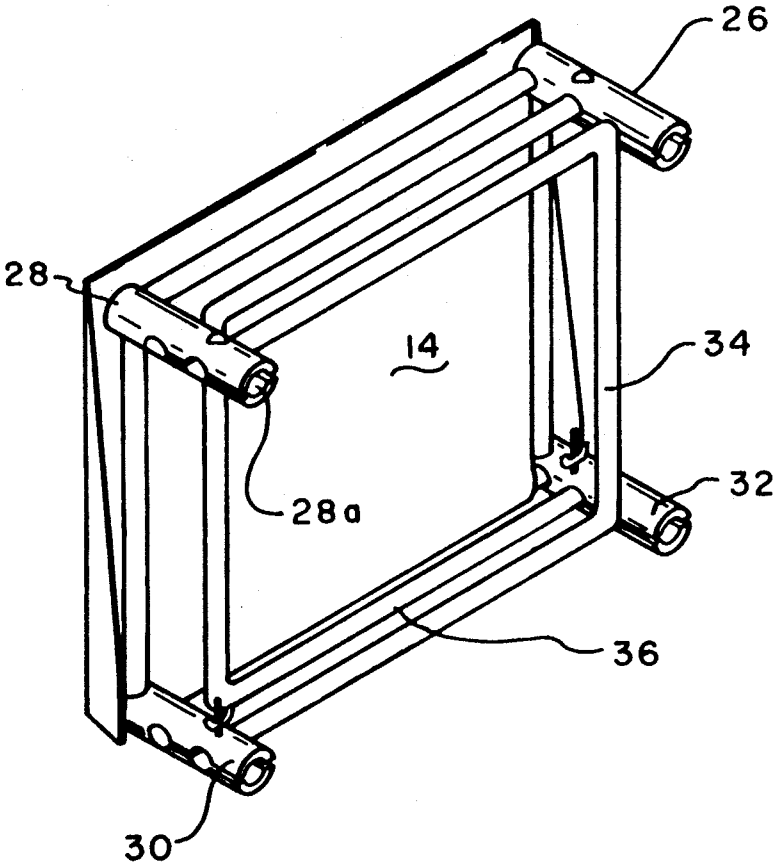
FIG. 4 is a rear isometric view of the refuse collector in the folded configuration.

The collection tray 14 includes integral side walls **14*a* and 14*b* which are upturned at angles of approximately 45 degrees and which function to retain refuse on the tray 14 and guide the refuse into the bag 12. The collection tray 14 further includes an integral hinge 14*c* (FIG. 5) 23 which extends through an angle of approximately 210 degrees so as to partially encircle the lower frame arm 18, thereby retaining the tray 14 to the arm 18 while also allowing the tray 14 to swing freely about the arm 18. The integral hinge 14*c* serves two purposes. First, it allows the tray 14 to swing downwardly freely so that the sharpened outer edge 14***d* of the tray 14 is flushly positioned against the ground, so that refuse can be swept onto the tray 14 with optimum collection efficiency. The hinge 14*c* also allows the tray 14 to be manually swung upwardly, both to dump refuse into the bag 12 and to allow the tray 14 to be folded into a compact storage position, as described further below and as shown in FIGS. 3 and 4.

The rectangular frame 16 includes four cylindrical hinge joints 26, 28, 30 and 32, which are substantially identical and which function to rigidly connect the frame arms 16–22 together to form a rectangular open frame through which refuse is conveyed into the bag 12. The hinge joints 26, 28, 30 and 32 also function to retain a pair of U-shaped bag expander arms 34 and 36. The expander arms 34 and 36 function to hold the bag 12 open in an expanded position, as shown in FIG. 1.

Figure 2:
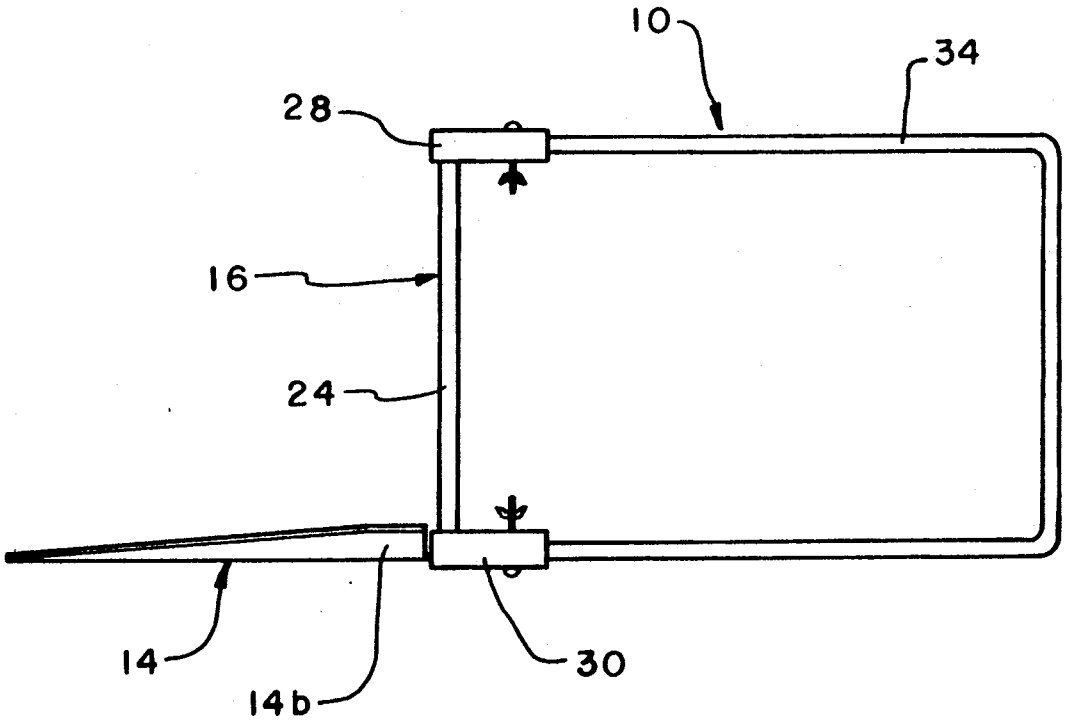
FIG. 2 is a side view of the refuse collector of FIG. 1, shown without a plastic trash bag.
Figure 7:
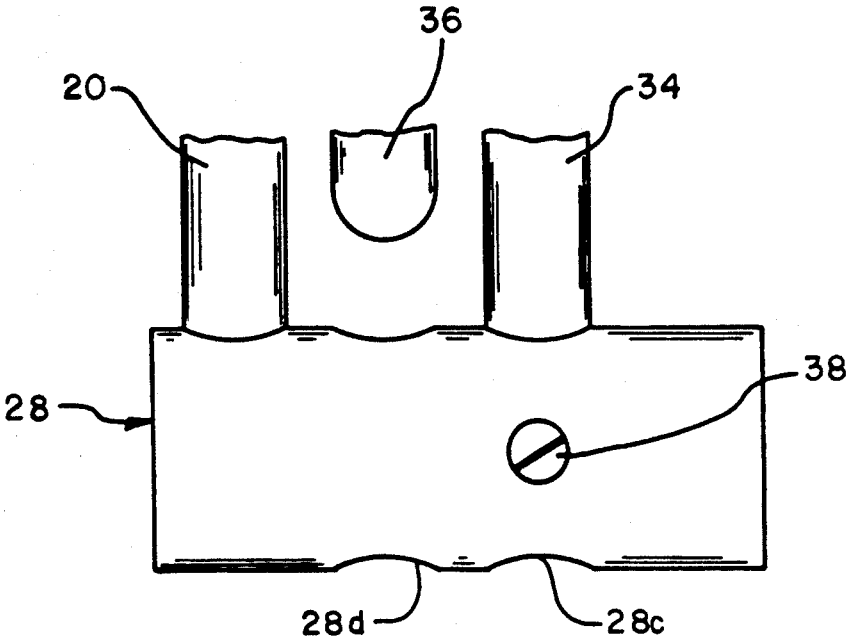
FIG. 7 is an enlarged plan view of the hinge joint of FIG. 6.
Figure 6:
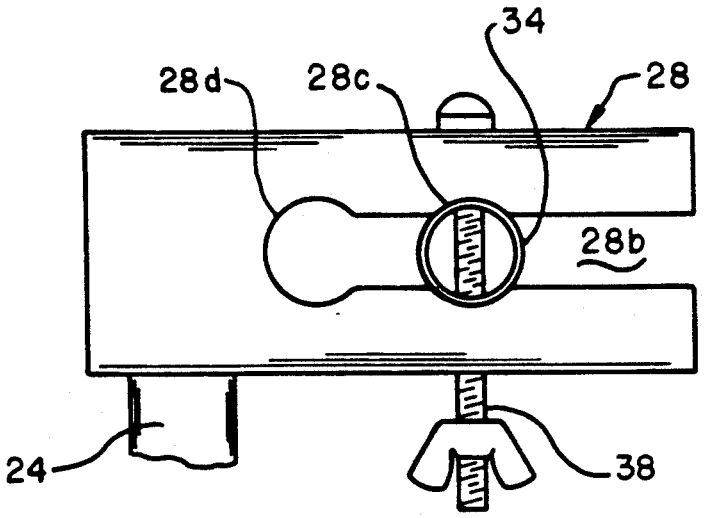
FIG. 6 is an enlarged side view of one of the hinge joints of the refuse collector.

The ends of the U-shaped expander arms 34 and 36 are hinged to the cylindrical hinge joints 26, 28, 30 and 32. FIGS. 6 and 7 illustrate in greater detail joint 28, which is illustrative of and identical to the other three hinge joints. The joint 28 includes a longitudinal bore 28*a* (FIG. 4) and a horizontal transverse slot 28*b* passing radially through the joint 28 and transecting the bore 28*a*. With the refuse collector 10 in the open position, as shown in FIGS. 1 and 2, the tubular end of expander arm 34 extends into the bore 28*a* and is retained by a pivot pin 38. The slot 28*b* allows the body of the joint 28 to flex sufficiently to allow the arm 34 to swing about the pivot pin 38 between the extended position, shown FIGS. 1 and 2, and a folded position, as shown in FIG. 4. In the folded position the end of the arm 34 resides in a cylindrically curved transverse rear detent 28*c* (FIGS. 6 and 7). Joint 28 includes a similar forward detent 28*d* which is located at the end of the slot 28*b*. The joint 28 is made of a resilient polymer, such that the end of tubular U-shaped arm 34 is resiliently retained in the extended position in the tubular bore 28*a* and is also resiliently retained in the folded position by the rear detent 28*c*.

The hinge joints 26, 28, 30 and 32 are all identical in construction to facilitate interchangeable construction and use. Each joint 26, 28, 30 and 32 includes a rear detent, such as 28*c*, as well as a forward detent such as 28*d*. In assembly, the expander arm 34 is hinged at the rear detent 28*c* of hinge joint 28 and the corresponding rear detent of joint 30, and the opposite expander arm 36 is hinged at the forward detents of hinge joints 26 and 32. This arrangement allows the two expander arms 34 and 36 to be folded into a compact position in which they are offset from one another, as shown in FIGS. 4 and 7.

In operation, the refuse collector 10 is opened to its extended position and inserted into a trash bag 12 as illustrated in FIG. 1. The collector is then laid on the ground and solid refuse is swept or raked onto the collection tray 14, from which it may be either swept into the bag 12 or dumped into the bag by raising the tray 14.

It will be appreciated that the refuse collector 10 can be used in a vertical position when appropriate. For this purpose, in the preferred embodiment the U-shaped expander arms 34 and 36 are flattened at their ends distal from the frame 16, so that the collector 10 may function in another capacity as a self-supporting stand that maintains the plastic trash bag 12 in an open, upright and fully expanded position. Further, when used in this capacity the tray 14 functions as a lid, covering the opening of the bag 12 when temporarily not in use, and which can also be opened and swung outwardly and downwardly alongside the outside of the bag 12 where it is out of the way while refuse is being introduced into the bag.

It will be appreciated that the refuse collector of the present invention is of particular application in connection with the collection and disposal of toxic or hazardous wastes, such as may be encountered in industrial or medical facilities, where contact with the refuse is sought to be avoided. One example is metal chips, which can be sharp and dangerous to handle manually, and which can also be contaminated with toxic oils or solvents. The collector is also useful in connection with refuse that may be contaminated with infectious substances, such as medical or sanitary refuse. In all of these cases the refuse can be collected for disposal without exposing the user to manual contact.

Although the embodiment of the refuse collector described above is intended to be reusable, the collector may also be manufactured in a disposable embodiment that is simplified and more inexpensive to construct. Such an embodiment may be simply left in the plastic trash bag and discarded along with the refuse when the bag has been filled. Such an embodiment is particularly useful for applications where it is expected that the collector itself will become contaminated with toxic or infectious materials, such that it is preferable to avoid any handling of the contaminated collector after it uas been used.

The present invention has been described and illustrated with reference to a preferred embodiment. Nevertheless, it will be understood that various modifications, alterations and substitutions may be apparent to one of ordinary skill in the art, and that such modifications, alterations and substitutions may be made without departing from the essential invention. Additionally, although the present invention is described as being useful in connection with the disposal of hazardous or toxic wastes, it is by no means intended that the present invention be limited to such uses; and in fact it is contemplated that the invention will be useful in connection with the disposal of ordinary household refuse as well. Accordingly, the present invention is defined only by the following claims.

The embodiments of the invention in which patent protection is claimed are:

1. A refuse collector for use with a plastic trash bag, said refuse collector comprising a rigid peripheral frame member defining a central opening therein, a collection tray hinged to said peripheral frame and extendable therefrom, first and second bag expander arms hinged to said frame member and extendable rearwardly therefrom, said frame member and said expander arms being sized and adapted so that said expander arms are extendible into a plastic trash bag so as to hold said bag open and positioned to receive refuse introduced into said bag from said collection tray and through said opening in said frame member.

2. The refuse collector defined in claim 1 wherein said frame member includes a tubular lower frame arm, and wherein said collection tray includes an integral hinge in the form of a continuous edge member thereof which is curled back upon itself to form a tubular hinge sleeve, said tubular hinge sleeve enclosing said tubular lower frame arm and thereby functioning as a hinge to allow said collection tray to rotate about said lower frame arm.

3. The refuse collector defined in claim 1 wherein said rigid frame member is generally rectangular, said frame member having four hinge joints, said frame member further having four frame arms connected to said hinge joints, said bag expander arms each being hinged to said hinge joints for swinging motion between a rearwardly extending position and a folded position for storage.

4. The refuse collector defined in claim 3 wherein said hinge joints include integral resilient detents for retaining said expander arms in either of said rearwardly extended or folded positions.

5. The refuse collector defined in claim 4 wherein each of said hinge joints is formed of a resilient polymeric material and is generally cylindrical in configuration, and wherein each of said hinge joints includes a rearwardly opening central cylindrical bore transected by a longitudinal slot passing through said hinge joint, and further wherein said expander arms are generally U-shaped and are formed of tubular cylindrical members having ends that are insertable into said cylindrical bores of said hinge joints, and pivot pins connecting said ends of said expander arms to said hinge joints.

6. The refuse collector defined in claim 5 wherein said hinge joints further include transverse detents for resiliently retaining said expander arms in said folded positions.

7. The refuse collector defined in claim 1 wherein said bag expander arms are U-shaped and include straight end segments whereby the collector may function as a selfsupporting stand to hold said bag open in an upright, vertical position.

* * * * *